US006557787B2

(12) United States Patent
Swan

(10) Patent No.: US 6,557,787 B2
(45) Date of Patent: May 6, 2003

(54) NOZZLE FOR AGRICULTURAL SPRAYERS

(75) Inventor: Trevor William Bartlett Swan, Cambridge (GB)

(73) Assignee: Hypro Corporation, New Brighton, MN (US)

( * ) Notice: Subject to any disclaimer, the term of this patent is extended or adjusted under 35 U.S.C. 154(b) by 0 days.

(21) Appl. No.: 10/156,265

(22) Filed: May 28, 2002

(65) Prior Publication Data

US 2003/0057302 A1 Mar. 27, 2003

Related U.S. Application Data

(63) Continuation-in-part of application No. 09/968,411, filed on Sep. 27, 2001, now abandoned.

(51) Int. Cl.[7] ..... B05B 1/00
(52) U.S. Cl. ..... 239/597; 239/601
(58) Field of Search ..... 239/597, 398, 239/407, 589, 598, 599, 601, 266, 267

(56) References Cited

U.S. PATENT DOCUMENTS

| | | | | |
|---|---|---|---|---|
| 251,448 A | * | 12/1881 | Vestal et al. | 239/596 |
| 1,276,245 A | * | 8/1918 | Millard et al. | 239/596 |
| 4,519,542 A | | 5/1985 | Johnston | |
| 4,527,745 A | | 7/1985 | Butterfield et al. | |
| 4,718,607 A | * | 1/1988 | Levine | 239/451 |
| 5,125,583 A | | 6/1992 | Strand | |
| 5,310,115 A | | 5/1994 | Broyhill | |
| 5,326,036 A | | 7/1994 | Wilger | |
| 5,887,390 A | | 3/1999 | Schulz et al. | |
| 5,927,606 A | | 7/1999 | Patterson | |

* cited by examiner

*Primary Examiner*—Lisa A. Douglas
(74) *Attorney, Agent, or Firm*—Thomas J. Nikolai; Nikolai & Merserau, P.A.

(57) ABSTRACT

A nozzle for delivering fluid evenly over a wide swath is disclosed. The nozzle has an elongated tip which has a stepped slot. Air eduction is also provided to reduce drift of the fluid being delivered through the nozzle.

17 Claims, 7 Drawing Sheets

NOZZLE FOR AGRICULTURAL SPRAYERS

This application is a continuation-in-part and claims the priority of U.S. application Ser. No. 09/968,411, filed Sep. 27, 2001 now abandoned and entitled "Nozzle for Agricultural Sprayers".

BACKGROUND OF THE INVENTION

I. Field of the Invention

The present invention relates to the application of crop protection chemicals such as fertilizers, herbicides, insecticides, fungicides and the like. More specifically, the present invention relates to nozzle arrangements for fluid spray applicators that ensure that the fluid is evenly delivered over a broad area.

II. Description of the Related Art

Most agricultural fluid spray application systems are mounted to the back of a vehicle. These systems typically include one or more tanks in which material to be applied is stored, an extended boom which carries a plurality of nozzles along the length of the boom, plumbing for carrying the material from the tanks to the nozzles, and at least one pump for forcing the material from the tanks through the plumbing and out the nozzles. There seems to be constant pressure placed upon equipment manufacturers to build larger booms so that it takes less time for people involved in chemical application to apply agricultural chemicals to a given area. Booms now reach more than 80 feet in length and weigh more than a ton. While very even distribution of the agricultural chemicals can be achieved with this equipment, there are certain inherent problems. These problems are exacerbated as booms get longer.

Booms of an extended length cannot simply be bolted to a vehicle. Complex suspension systems are required to ensure that the boom is properly supported. Shock absorbers must also be provided because farm fields, range land, pastures, golf courses, etc. where such equipment is used are not flat. Vehicles carrying the boom often encounter uneven terrain, ruts, rocks or other obstacles. These all can impart motion to the vehicle which is exacerbated over the length of the boom.

Boom leveling systems also must be provided, particularly if the vehicle is operating on a hillside. Quality boom leveling systems will keep the boom parallel to the ground. This is important for at least three reasons. First, if the boom is not parallel to the ground, the delivery of the chemicals is uneven. Second, if an end of the boom contacts the plants being treated, the plants can be damaged. Third, if the end of the boom contacts the ground, the boom can be damaged.

Agricultural equipment, including boom type sprayers, often need to be transported on public roads. A vehicle with an 80 foot boom in its extended position cannot simply be driven down a public road. Thus, booms must be built to incorporate a series of hinge sections. This greatly increases the cost of the boom.

In addition to the cost added by incorporating proper suspension, proper shock absorption, proper leveling and proper boom-folding technology, use of an extended boom is not always suitable. This is particularly true when spraying utility and transportation right-of-ways, nursery and foresting stock, or orchards and vineyards. Significant issues arise when any obstacle is encountered such as road signs, bridges, fences, trees, or the like.

Many of the problems outlined above can be overcome either by reducing the length of the boom or eliminating the boom altogether. Thus, in recent years there have been efforts to develop boomless sprayer type applicators. Yet these boomless sprayers have problems of their own. For a variety of reasons, no one to date has been able to develop a boomless sprayer that delivers the chemicals as evenly and accurately as desired. Even and accurate delivery of the chemicals not only can serve to decrease chemical costs and improve crop yields, it also has other environmental benefits.

There is, thus, a real need for a nozzle arrangement that can be used either to provide a boomless spray system or to extend the reach of spray systems incorporating booms. Such a nozzle must be able to deliver agricultural materials evenly, uniformly, accurately, precisely and efficiently over a broad area. Such a nozzle must also be durable and designed so worn parts can be easily replaced.

SUMMARY OF THE INVENTION

The present invention relates to nozzles for agricultural sprayers. One object of the invention is to provide such a nozzle which will provide even distribution of agricultural chemicals.

Another object of the invention is to provide such a nozzle capable of delivering suitably large quantities of agricultural chemicals over a short period of time.

Still another object of the invention is to provide a nozzle capable of evenly distributing the chemicals over a desired swath that can reach 30 feet in width or more.

A further object of the invention is to provide a nozzle that provides not only uniformity of spray over a wide area, but also sufficient accuracy of product delivery to ensure that the chemicals are sprayed only where intended.

Another object of the present invention is to provide a nozzle which is durable.

Still another object of the present invention is to provide a nozzle which has wear parts that are easily replaceable when necessary.

A further object of the invention is to provide a nozzle that not only meets each of the foregoing objectives, but does so over a wide range of spray widths and spray flow rates.

Each of the foregoing objects of the invention are achieved by providing a unique nozzle arrangement through which agricultural chemicals can be delivered. In one embodiment, the nozzle has a body member, a flow regulator, a spray tip, and a cap. In another embodiment, a separate air eductor is also provided. The design of the spray tip is such that fluid existing the tip does so in a way that ensures accuracy and uniformity of delivery over a wide swath.

Other objects and advantages of the invention will become apparent from the following detailed description of the preferred embodiments in view of the drawings which are briefly described below.

DETAILED DESCRIPTION OF THE PREFERRED EMBODIMENTS

Figure 1:
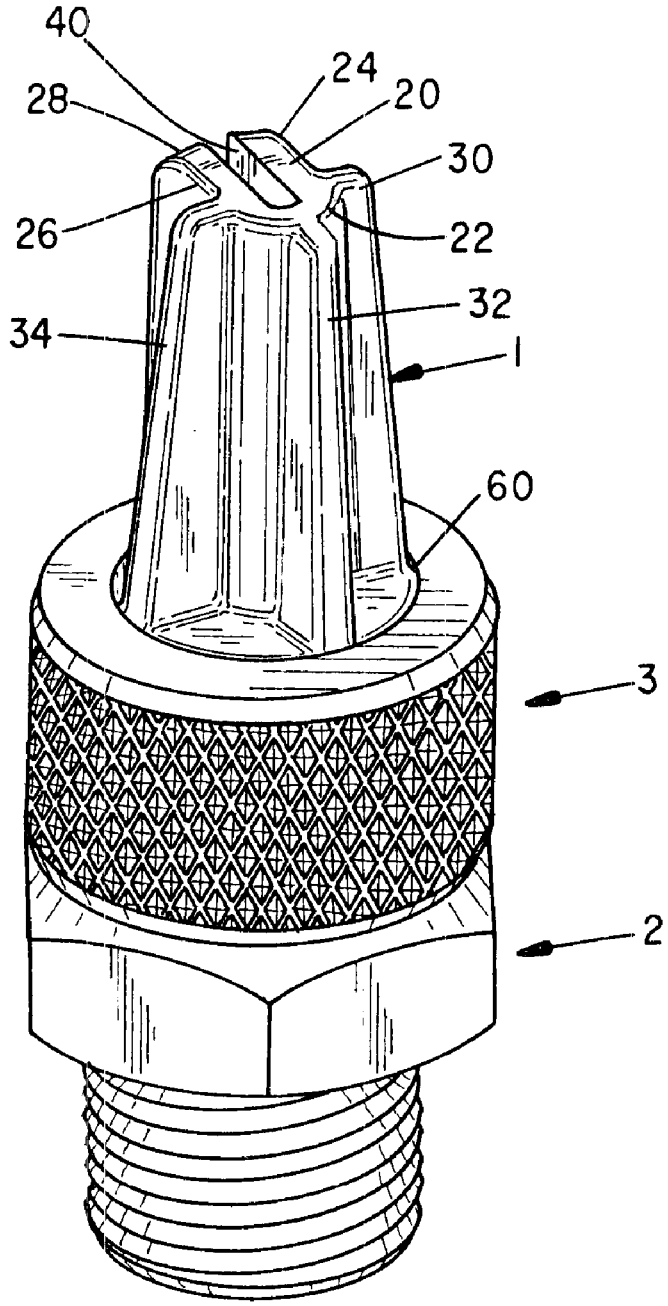
FIG. 1 is a perspective view showing a nozzle designed in accordance with the present invention.
Figure 2:
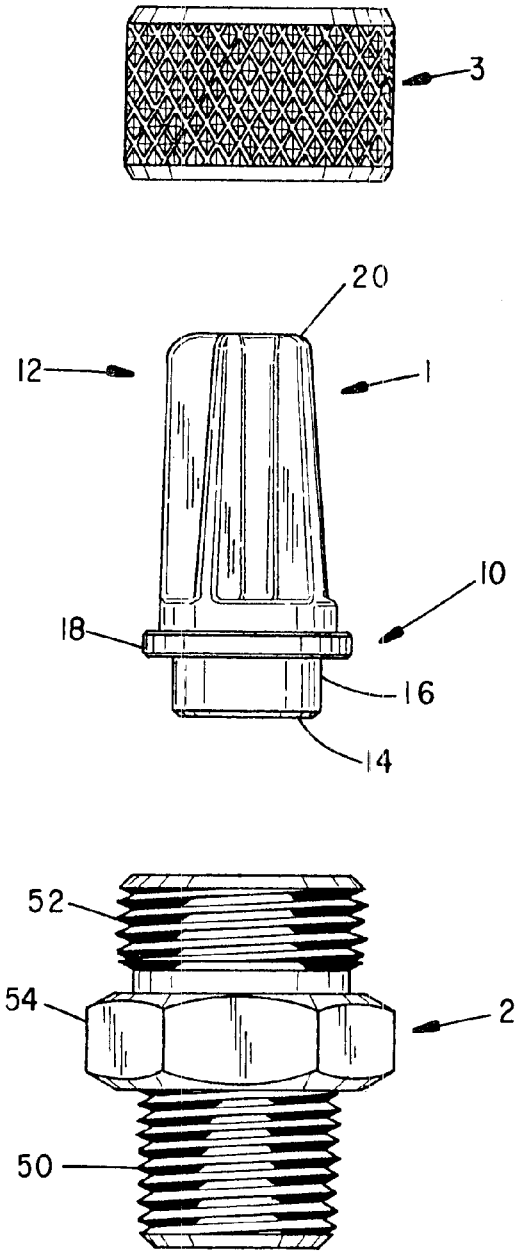
FIG. 2 is an exploded view showing the components of the nozzle shown in FIG. 1.
Figure 3:
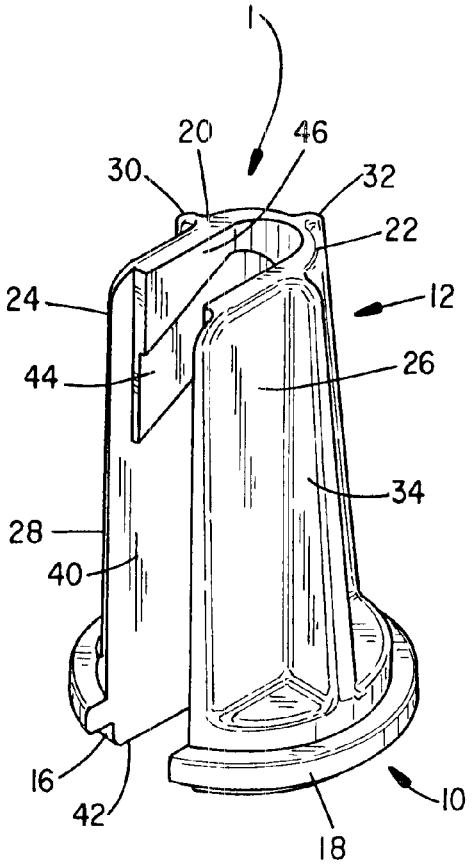
FIG. 3 is a perspective view of the spray tip of the nozzle shown in FIG. 1.
Figure 4:
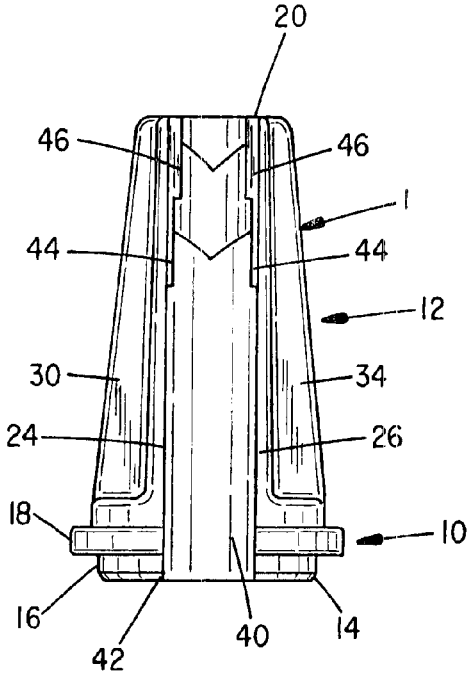
FIG. 4 is a front view of the spray tip shown in FIG. 3.
Figure 5:
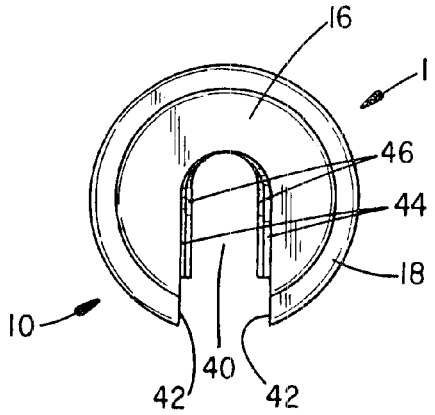
FIG. 5 is a bottom view of the spray tip shown in FIG. 3.
Figure 6:
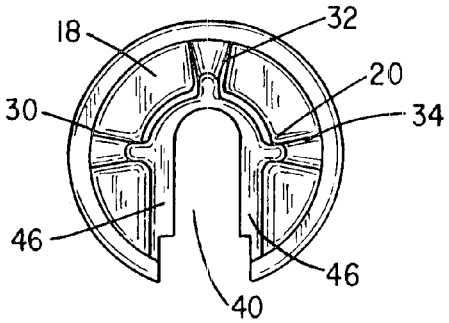
FIG. 6 is a top view of the spray tip shown in FIG. 3.
Figure 7:
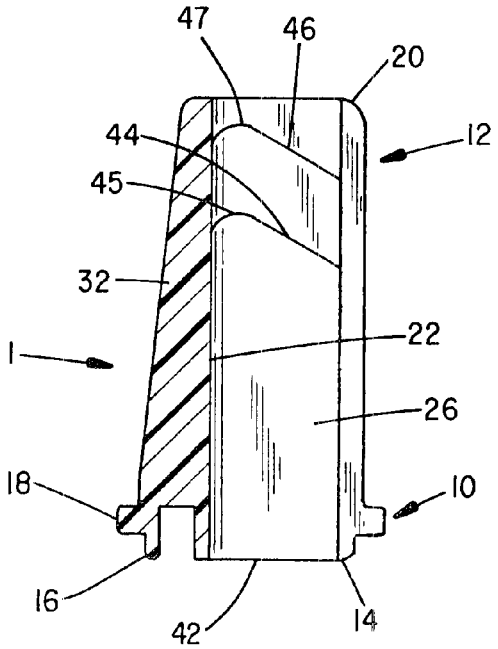
FIG. 7 is a cross-sectional view of the spray tip shown in FIG. 3.

FIGS. 1–9 show a first embodiment of the nozzle of the present invention. As shown, the nozzle includes a spray tip 1, a spray tip connector 2 and a cap 3. Each of these components is discussed in greater detail below.

The spray tip 1 includes a base 10 and an elongated member 12. The base 10 is at the upstream end 14 of the spray tip 1 and includes a projection 16 and a flange 18. The elongated member 12 extends from the base 10 and terminates at the downstream end 20 of the spray tip 1. The elongated member includes a back wall 22 and a pair of opposing side walls 24 and 26. The front 28 is open as discussed below. Also present are three exterior stiffeners 30, 32 and 34 which provide rigidity to the walls 22, 24 and 26. This serves to strengthen the entire spray tip.

Extending the entire length of the spray tip 1 is an open slot 40. The slot 40 is open through the upstream end 14, the downstream end 20 and the entire front 28. Located within the slot 40 and projecting toward the center of the slot 40 from each side 24 and 26 are three steps. These steps may, but do not necessarily, project toward the center of the slot 40 from the back 22 as well. As shown, steps 42, 44 and 46 project inwardly from sides 24 and 26. As such, the slot 40 is widest between the upstream end 14 and the step 42. The slot 40 is narrowest between the downstream end 20 and the step 46. The step 42 generally runs parallel to (or, as shown, is contiguous with) the upstream end 14. The steps 44 and 46 run generally parallel to each other, but not parallel to either the downstream end 20 or the upstream end 14. Near the back 22, the steps are nearer to the downstream end than they are near the front 28. The steps 44 and 46 preferably slope at an angle of approximately 60° from near the back 22 toward the front 28. Steps 44 and 46 also included an arc. As shown, these arcs are 45 and 47. The slot 40 is also tapered from front to back so that it is slightly wider near the back wall 22. This taper can be adjusted to alter the spray pattern achieved by the nozzle.

Figure 9:
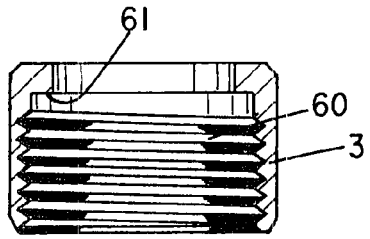
FIG. 9 is a cross-sectional view of the cap of the nozzle shown in FIG. 1.

The spray tip connector 2 includes a pair of threaded members 50 and 52 projected in opposite directions from a nut-shaped member 54. Threaded member 50 can be used to attach a tube (not shown) such as a hose or pipe to the nozzle. A lumen 56 runs through the center of the base 2. The threaded member 52 cooperates with threads on the cap 3 to secure the spray tip 1 in place. As shown in FIG. 9, the cap 3 has an open channel 60 through which the elongated member 12 of the spray tip 1 can pass. To assemble the nozzle, the projection 16 of the spray tip 1 is inserted into the lumen 56 until the flange 18 engages the upstream end 53 of the spray tip connector 2. The elongated member 12 of the spray tip 1 is inserted through the open channel 60 of the cap 3 until the flange 18 engages the shelf 61 of the cap 3. The threads of the cap 3 and threaded member 52 are used to join the spray tip connector 2 to the cap 3. When the cap 3 and spray tip connector 2 are tightened, the flange 18 engages surfaces 53 on the spray tip connector 2 and surface 61 on the cap 3 to ensure proper alignment of the parts and a tight fit. When so assembled, a slight gap may exist between the projection 16 of the spray tip 1 and interior structures (such as 55) in the lumen 56 of the spray tip connector 2. Such a gap may serve to provide a larger chamber or zone in which liquid and air can mix prior to liquid being ejected through the spray tip 1. Of course, such mixing of liquid and air occurs in the spray tip itself.

Figure 8:
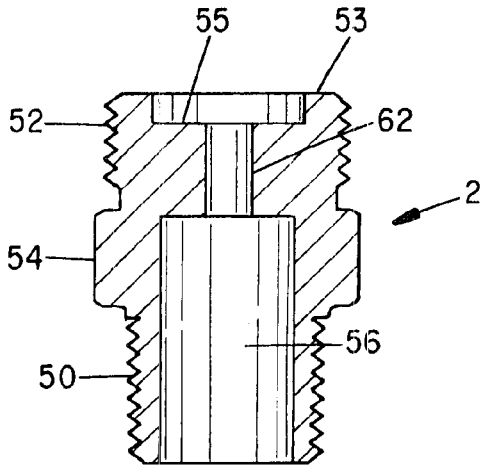
FIG. 8 is a cross-sectional view of the spray tip connector shown in FIG. 1.

To provide proper flow of liquid through the spray tip 1, a flow regulator 62 can be provided. This flow regulator 62 can be integrally formed within the lumen 56 of the spray tip connector 2 as shown in FIG. 8. Preferably, however, the flow regulator 62 will be a separate component.

Figure 10:
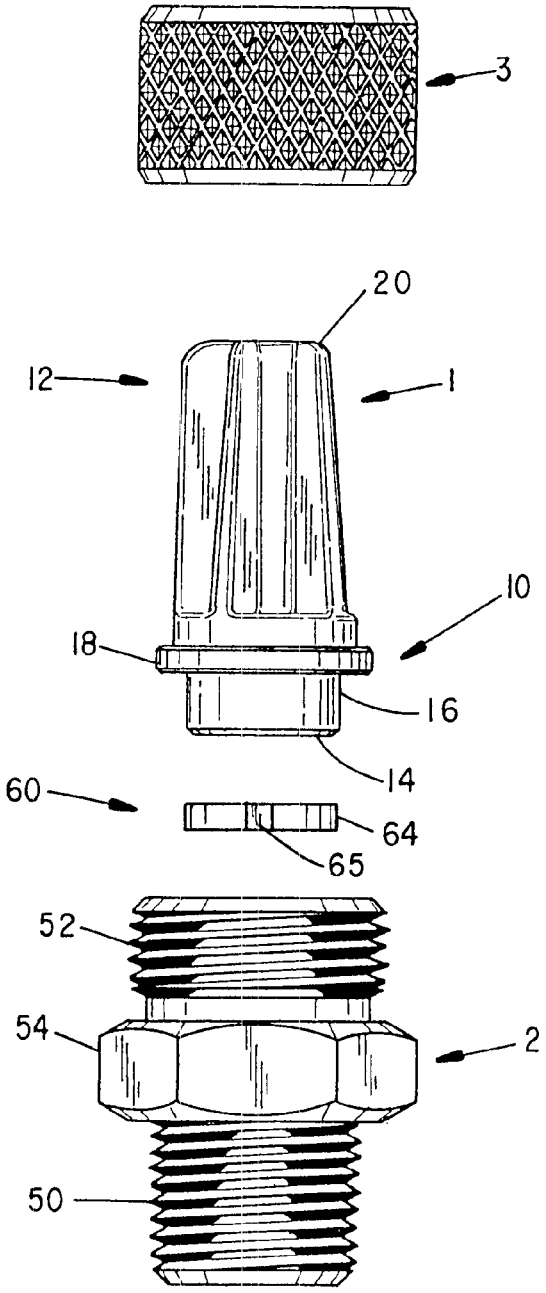
FIG. 10 is an exploded view showing a first alternative embodiment.
Figure 11:
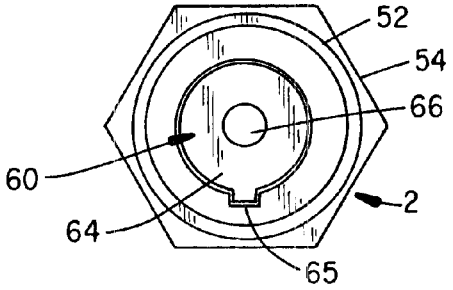
FIG. 11 is a top view showing the spray tip connector and regulator disk of the embodiment shown in FIG. 10 in assembled relation.

As shown in FIG. 10, a flow regulator 62 is provided. The flow regulator 62 is a separate disk 64 with an orifice 66 through it. The flow regulator is designed to reside within the lumen 56 of the spray tip connector 2 so that it can restrict the flow of liquid into the spray tip 1. Ideally, the orifice 66 will be non-symmetrical rather than perfectly round. An oblong configuration, for example, not only restricts the volume of liquid entering the stray tip, but also permits one to direct or steer the flow stream to affect the way it enters the spray tip. To ensure that the stream is properly directed, the disk 64 can have a keying element 65 that meshes with a keying element on either the spray tip 1 or the spray tip connector 2.

When the nozzle described above is used, superior distribution of the liquid is achieved. The distribution is even over the whole swath. The swath is wide enough to equal that of many boom arrangements. The chemicals are delivered at a sufficient rate to provide efficient application. A plurality of such nozzles can be used to increase the efficiency of the system or provide a wider swath than can be achieved with a single nozzle.

As the liquid is pumped through the nozzle, air is educted into the flow stream through the slot 40 and mixes with the liquid before the liquid is dispensed. This produces large, air-filled droplets of liquid. The larger droplets reduces drift of the liquid permitting precise application.

Figure 12:
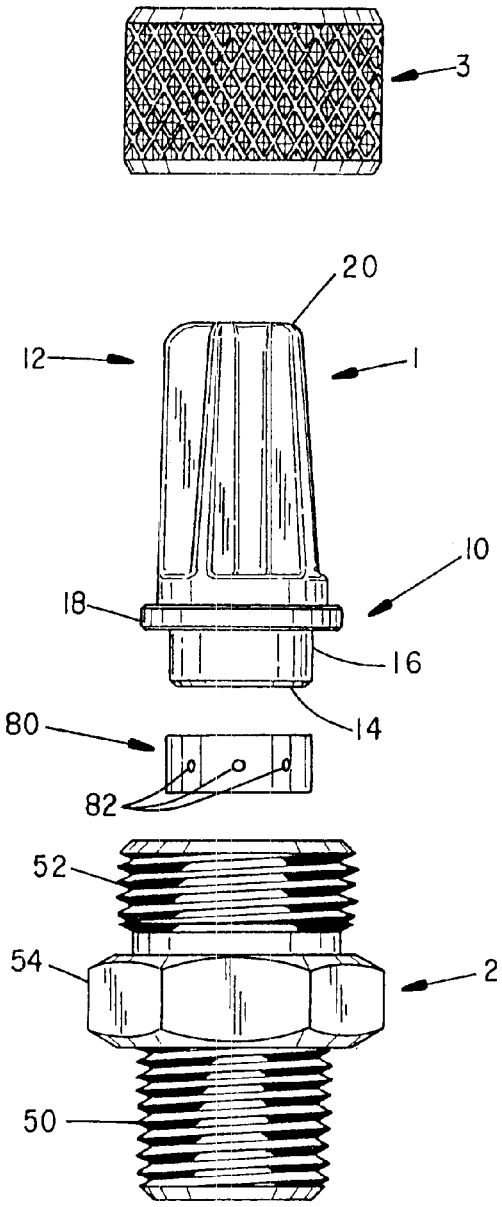
FIG. 12 is an exploded view showing a second alternative embodiment of the present invention.

While the mixing that occurs by air being drawn through the slot and mixed with the liquid before it is ejected is sufficient for many applications, the quantity of air mixed with the liquid can be increased by providing a separate air eductor upstream of the spray tip. This arrangement is shown in FIG. 12.

As shown, the air eductor 80 resides in the liquid flow path between the spray tip 1 and the spray tip connector 2. It includes an interior chamber in fluid communication with both the lumen 56 of the spray tip connector 2 and the slot 40 of the spray tip 1. The air eductor 80 also includes one or more air entry channels 82 in communication with the interior chamber. As liquid passes under pressure through the interior chamber, air is drawn through the air entry channels 82 into the chamber and mixes with the liquid.

Figure 13:
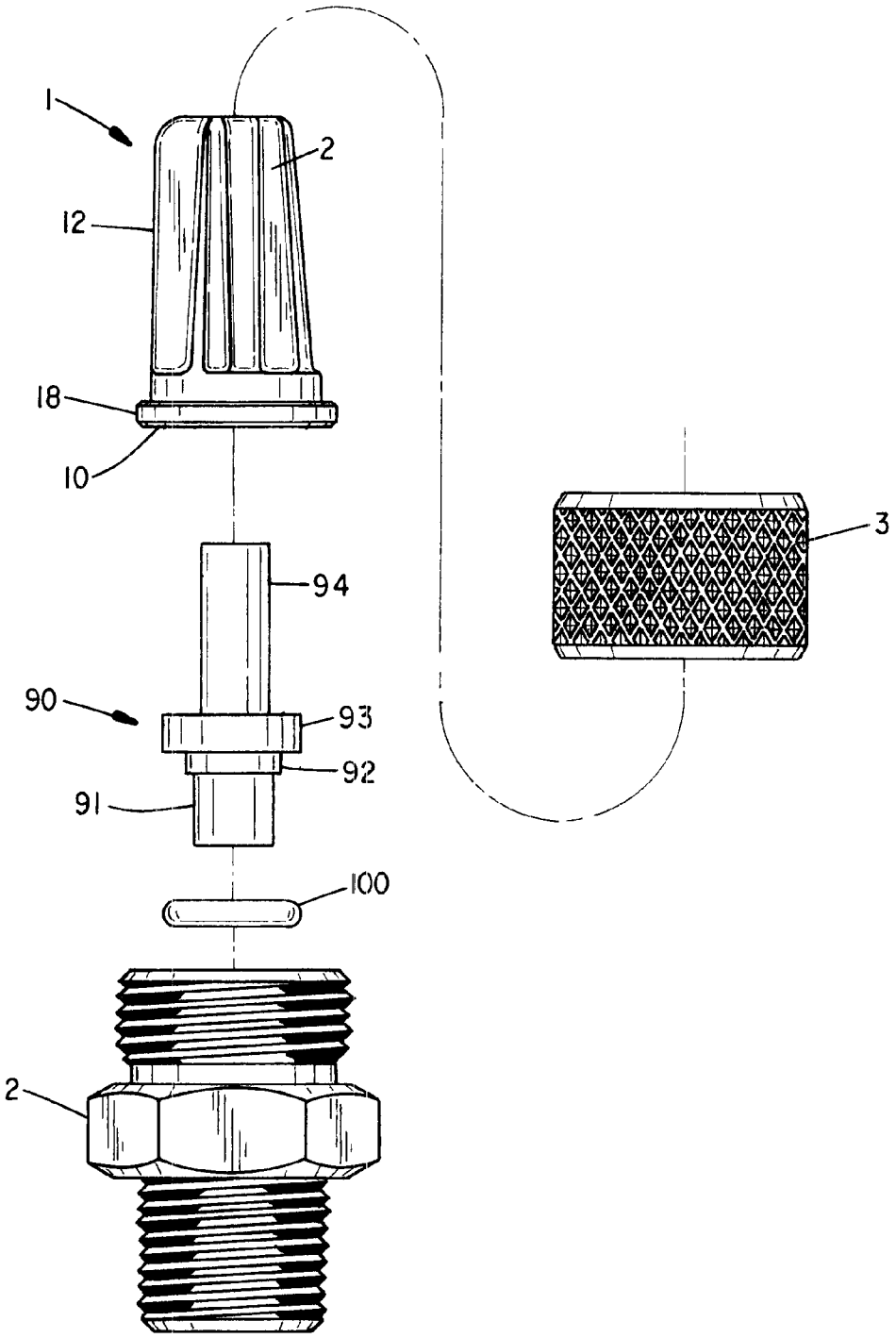
FIG. 13 is an exploded view showing a third embodiment of the present invention.
Figure 14:
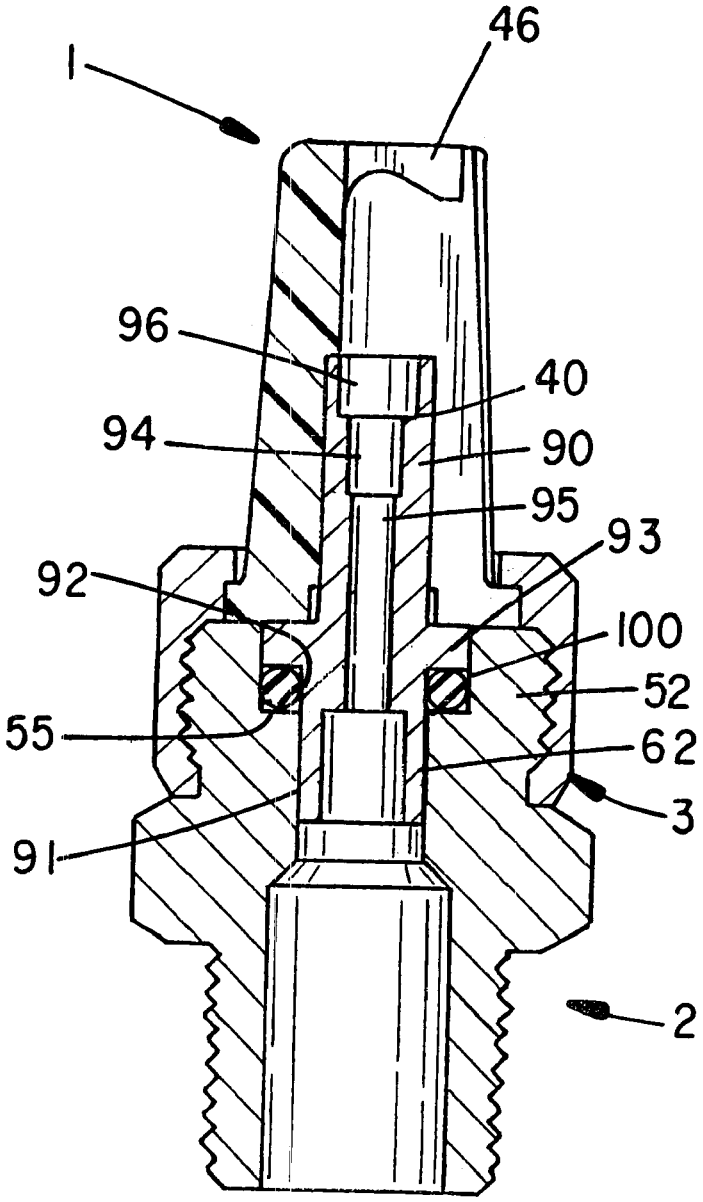
FIG. 14 is a cross-sectional view of the embodiment of FIG. 13 when the components are assembled.

FIGS. 13 and 14 are provided to show still another embodiment of the present invention. Like the embodiments shown in FIGS. 1–12, this embodiment includes a spray tip 1, spray tip connector 2, and a cap 3. This embodiment also includes a flow regulator insert 90 and an O-ring 100. The cap 3 is identical to the cap shown in connection with the previously described embodiments. However, changes have been made to the spray tip 1 and spray connector 2 to accommodate the flow regulator insert 90 and O-ring 100.

As shown in FIG. 13, the spray tip 1 has a base 10, an elongated member 12 and a flange 18. The projection 16 (shown in the previously described embodiments) has been eliminated from the spray tip 1. The exterior of the spray tip connector 2 of the embodiment of FIGS. 13 and 14 is the same as that shown in the drawings related to the embodiments discussed above. However, a comparison of FIG. 8 with FIG. 14 shows that the inside diameter of the flow regulator 62 has been made larger in the embodiment shown in FIGS. 13 and 14.

The changes discussed in the preceding paragraph were made to accommodate the use of the flow regulator insert 90 and O-ring 100. As shown in FIG. 13, the flow regulator insert 90 includes an upstream extension 91, an O-ring seat 92, an insert flange 93 and a downstream extension 94. A lumen 95, open to opposite ends of the insert 90, extends its entire length. The outside diameter of the upstream extension 91 must be less than the inside diameter of the flow regulator 62 of the spray tip connector 2.

When assembled, the O-ring 100 is slid over the end of the upstream extension 91 and resides around the O-ring seat 92 in contact with the upstream side of the insert flange 93. The upstream extension 91 is then inserted into the flow regulator 62 of the spray tip connector 2 until the O-ring 100 makes contact with seating surface 55 of the spray tip connector 2. The purpose of the O-ring 100 is to provide a seal between the spray tip connector 2 and the flow regulation insert 90. Next, the downstream extension of flow regulation insert 90 is inserted into the slot 40 of the spray tip 1. When so assembled, the downstream extension 94 extends approximately ¾ of the length of the spray tip 1. Finally, the cap 3 is slid over the spray tip 1 and tightened to the threaded member 52 of the spray tip connector 2 to complete assembly of the nozzle. The nozzle can then be attached to a hose using the threaded member 50 of the spray tip connector 2.

In the embodiment of FIGS. 13 and 14, flow out of the nozzle is controlled by the shape of the spray tip 1 and the length of insert 90 as well as the shape of the walls of its lumen. For example, a camber 96 can be created in the area where the liquid exits the insert 90 to improve backfilling of the spray pattern. Changes to the length of insert 90 and the shape of the walls of its lumen can be made without deviating from the invention.

Several advantages are provided by the embodiment shown in FIGS. 13 and 14. First, because the downstream extension 94 of insert 90 extends up into the spray tip 1, the flow of liquid is directed to the working end of the spray tip 1 resulting in greater consistency and control of dispersion of the liquid by the nozzle. Second, the O-ring 100 prevents unintended leakage of liquid from the spray tip connector 2 to the spray tip 1. Such leakage, if permitted, can adversely affect the spray pattern of the nozzle. Third, the positioning of the spray tip 1 and insert 90 reduces the chance of misalignment of the liquid stream to the steps located within the slot 40. Fourth, the number of impingement steps can be reduced making construction of the spray tip 1 easier. In fact, only one step may be needed when insert 90 is used. Fifth, the camber in the area where the liquid exits the insert 90 results in improved backfilling of the spray pattern so that the quantity of liquid delivery is substantially consistent throughout the entire pattern.

While the various embodiments shown all include a separate spray tip, spray tip connector and cap, various components can be integrally molded without deviating from the scope and spirit of this invention. For example, the spray tip and spray tip connector can be integrally molded. When this is the case, and with slight modifications to the design, there is no need to provide a cap. Since these and other changes could be made by one of ordinary skill in the art using this specification as a guide, the foregoing description is not intended to be limiting and the inventor seeks to protect all that is covered by the following claims, including a full range of equivalents.

What is claimed is:

1. A nozzle comprising:

a. a spray tip having a base at its upstream end, an elongated member projecting from said base and terminating in a downstream end, and an open slot extending substantially the length of said spray tip, said slot having a pair of sides, each of said sides having a plurality of steps such that said slot is narrowest near the downstream end;

b. a spray tip connector having an opening therethrough and adapted to be connected to a tube such that fluid passing through said tube also passes through said opening; and c. a cap for securing said spray tip so that fluid passing through said opening in said spray tip connector passes through said slot.

2. The nozzle of claim 1 wherein said slot and said steps are arranged such that air is drawn into said slot and mixed with fluid in said slot before said fluid exits said slot.

3. The nozzle of claim 1 further including a regulator disk having an orifice therethrough for controlling the flow of fluid into the spray tip.

4. The nozzle of claim 3 wherein said orifice is slightly non-symmetrical.

5. The nozzle of claim 1 further including an air eductor located between said base and said spray tip, said air eductor including a channel through which air can enter the air eductor to be combined with fluid passing through the nozzle.

6. A nozzle comprising:

a. a spray tip having an elongated member terminating in a downstream end and an open slot extending substantially the length of said spray tip, said slot having a pair of sides, each of said sides having a plurality of steps such that said slot is narrowest near the downstream end; and b. a spray tip connector integrally formed with said spray tip upstream of said spray tip and adapted to be connected to a tube such that fluid can enter the nozzle through the tube.

7. The nozzle of claim 6 wherein said slot and said steps are arranged such that air is drawn into said slot and mixed with fluid in said slot before said fluid exits said slot.

8.The nozzle of claim 6 further including a flow regulator positioned upstream of said spray tip, said flow regulator having an orifice for controlling flow of liquid from the tube into said spray tip.

9. The nozzle of claim 8 wherein said orifice is non-symmetrical.

10. The nozzle of claim 1 further including an air channel upstream of said spray tip which educts air into the nozzle.

11. A nozzle for spraying liquid comprising:

a. a spray tip having a base at its upstream end, an elongated member projecting from said base and terminating in a downstream end, and an open slot extending substantially the length of said spray tip, said slot having a pair of sides, each of said sides having a plurality of steps such that said slot is narrowest near the downstream end;

b. means for connecting said spray tip to a source of liquid;

c. a flow restrictor; and d. means for educting air into the nozzle.

12. The nozzle of claim 11 wherein said means for educting air into the nozzle includes at least a portion of said slot.

13. The nozzle of claim 12 wherein said means for educting air into the nozzle further includes a mixing chamber between said flow restrictor and said spray tip.

14. The nozzle of claim 11 wherein said means for educting air into the nozzle includes an air eductor having an interior chamber and at least one air entry channel in communication with said interior chamber.

15. A nozzle comprising:

a. A spray tip having a base at its upstream end, an elongated member projecting from said base and terminating at a downstream end, and an open slot extending substantially the length of said spray tip, said slot having a pair of sides, each of said sides having at least one step such that said slot is narrowest near the downstream end;

b. a spray connector having an opening therethrough, a seat member located in said opening; a first connecting member adapted to be connected to a tube such that fluid passing through said tube also passes through said opening, and a second connecting member;

c. a flow regulation insert having an upstream extension, a flange, a downstream extension, and a lumen; said upstream extension sized to fit within said opening of said spray connector and said downstream extension sized to fit within said open slot of said spray tip so that said downstream extension extends toward the downstream end of said spray tip;

d. a cap for securing said spray tip so that fluid passing through said opening in said spray tip connector passes through the lumen of said flow regulation insert and said slot of said spray tip.

16. The nozzle of claim 15 further including an O-ring that resides between said seat member of said spray connector and said flange of said flow regulation insert to form a seal.

17. The nozzle of claim 15 wherein said lumen of said flow regulation insert has a camber in the area where fluid exits said flow regulation insert.

* * * * *

UNITED STATES PATENT AND TRADEMARK OFFICE

CERTIFICATE OF CORRECTION

PATENT NO. : 6,557,787 B2
DATED : May 6, 2003
INVENTOR(S) : Trevor William Bartlett Swan It is certified that error appears in the above-identified patent and that said Letters Patent is hereby corrected as shown below:

Column 8,
Line 26, the word "camber" should read -- chamber --.

Signed and Sealed this

First Day of July, 2003

JAMES E. ROGAN
*Director of the United States Patent and Trademark Office*